US006247442B1

(12) United States Patent
Bedard et al.

(10) Patent No.: US 6,247,442 B1
(45) **Date of Patent: *Jun. 19, 2001**

(54) COMBINED AIR BOX, COOLANT RESERVOIR AND OIL TANK FOR SNOWMOBILES

(75) Inventors: Michael A. Bedard; Ellsworth J. Hagen, both of Roseau, MN (US)

(73) Assignee: Polaris Industries Inc., Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/444,270

(22) Filed: Nov. 19, 1999

(51) Int. Cl.[7] ..... F02B 77/00; F01P 3/22; F02M 35/10

(52) U.S. Cl. ..... 123/198 E; 123/184.21; 123/41.54

(58) Field of Search ..... 123/198 E, 41.54, 123/184.21, 196 R

(56) References Cited

U.S. PATENT DOCUMENTS

| | | | | |
|---|---|---|---|---|
| D. 396,045 | * | 7/1998 | Neeley | D15/1 |
| D. 414,498 | * | 9/1999 | Yoshida | D15/1 |
| 3,986,574 | | 10/1976 | Irvine | 180/68.1 |
| 4,370,957 | | 2/1983 | Skatsche et al. | 123/196 AB |
| 4,510,739 | * | 4/1985 | Dluhosch | 56/17.5 |
| 4,590,890 | * | 5/1986 | Tamba et al. | 123/41.7 |
| 5,020,484 | | 6/1991 | Ishiawa et al. | 123/73 AD |
| 5,040,503 | * | 8/1991 | Schwabe et al. | 123/198 E |
| 5,117,932 | | 6/1992 | Kurosu et al. | 180/68.2 |
| 5,152,365 | | 10/1992 | Aoshima | 180/68.3 |
| 5,174,258 | | 12/1992 | Tanaka | 123/198 E |
| 5,197,426 | * | 3/1993 | Frangesch et al. | 123/198 E |
| 5,423,279 | | 6/1995 | Long | 114/343 |
| 5,647,306 | | 7/1997 | Pateman | 123/41.33 |
| 5,913,295 | * | 6/1999 | Sadr et al. | 123/198 E |
| 5,971,062 | * | 10/1999 | Sadr et al. | 165/104.32 |
| 6,092,498 | * | 7/2000 | Lohr et al. | 123/90.38 |

* cited by examiner

*Primary Examiner*—Andrew M. Dolinar
*Assistant Examiner*—Hai Huynh
(74) *Attorney, Agent, or Firm*—Fredrikson & Byron, P.A.

(57) ABSTRACT

A combined air box, coolant reservoir and oil tank for a snowmobile. The combination unit comprises a molded housing having a set of exterior walls defining an interior cavity, and at least two interior walls dividing the interior cavity into at least three chambers, namely an air box chamber, a coolant reservoir chamber, and an oil tank chamber. Each of these three chambers thus is defined by at least a portion of the exterior walls and at least a portion of at least one of the interior walls.

6 Claims, 12 Drawing Sheets

COMBINED AIR BOX, COOLANT RESERVOIR AND OIL TANK FOR SNOWMOBILES

TECHNICAL FIELD

The invention relates to snowmobiles, and, in particular, to a combined air box, coolant reservoir and oil tank for snowmobiles.

BACKGROUND OF THE INVENTION

Snowmobiles generally are powered by two cycle engines. Two cycle engines typically require that oil be mixed with the fuel to provide lubrication to the internal moving parts of the engine. While many small two cycle engines, such as those employed on lawn mowers, chain saws, whip string trimmers, etc., require the oil to be mixed with the fuel before the fuel is poured into the gas tank, snowmobiles typically employ a two-cycle engine oil tank connected to a fuel/oil mixing apparatus. Thus, the user can fill up the gas tank with regular gas, fill up the oil tank with two-cycle engine oil, and rely on the fuel/oil mixing apparatus to properly blend the oil with the gas just prior to delivery of the gas to the engine for combustion. While this arrangement is convenient for the user, it does require the mounting of an oil tank in a location easily accessible by the user.

The engines on some snowmobiles are simply air cooled. Higher performance and larger sized engines, however, often are liquid cooled—i.e., the engine has a water jacket connected to a radiator or other similar system for dissipating heat that is absorbed by coolant in the water jacket. The coolant may be of any suitable type, such as that commonly used in automobile engines (i.e., usually it is not just water, as water would freeze, but rather a mixture of water with, e.g., ethylene glycol). As in automobiles, desirably a coolant reservoir/overflow tank is provided to assure that the cooling system on the engine (i.e., the water jacket, radiator, etc.) is always full of coolant. This, however, also requires the mounting of a coolant reservoir in a location easily accessible by the user.

Snowmobiles typically also include an air box through which all air provided to the engine for combustion must pass. The air box may include an air filter to prevent debris from entering the engine, and it also serves to reduce engine noise by muffling somewhat the sounds generated by combustion in the engine cylinders.

SUMMARY OF THE INVENTION

The invention provides a combined air box, coolant reservoir and oil tank for a snowmobile, the combination of these three features in a single component having the advantages of saving space and weight, reducing the number of components on the snowmobile, and therefor saving cost. The device comprises a molded housing having a set of exterior walls defining an interior cavity, and at least two interior walls dividing the interior cavity into at least three chambers, namely an air box chamber, a coolant reservoir chamber, and an oil tank chamber, each such chamber being defined by at least a portion of the exterior walls and at least a portion of at least one of the interior walls.

DETAILED DESCRIPTION OF THE INVENTION

Figure 1:
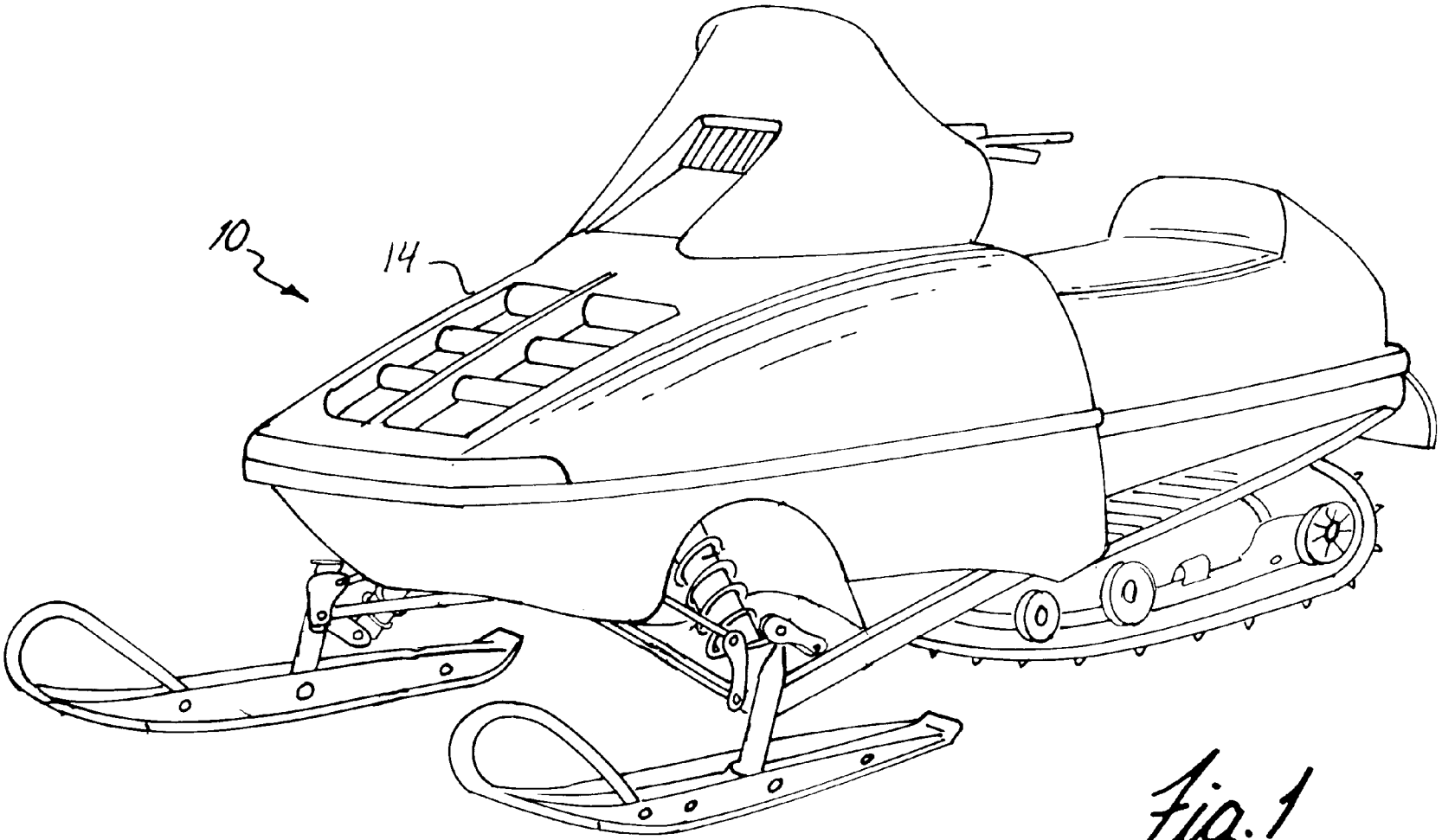
FIG. 1 is a perspective view of a snowmobile in which the combined air box, coolant reservoir and oil tank of the invention is mounted.

FIG. 1 depicts generally a snowmobile 10 of the invention in which the combined air box, coolant reservoir and oil tank of the invention 20 (sometimes referred to as the "combination unit") is mounted. The combination unit 20 preferably is located beneath the hood 14 of the snowmobile. The front end of the hood 14 is connected by a hinge to the snowmobile chassis so that the rear end of the hood 14 can be lifted upwardly to provide access to the engine compartment, and the combination unit 20 preferably is mounted near the rear of the engine compartment.

Figure 2:
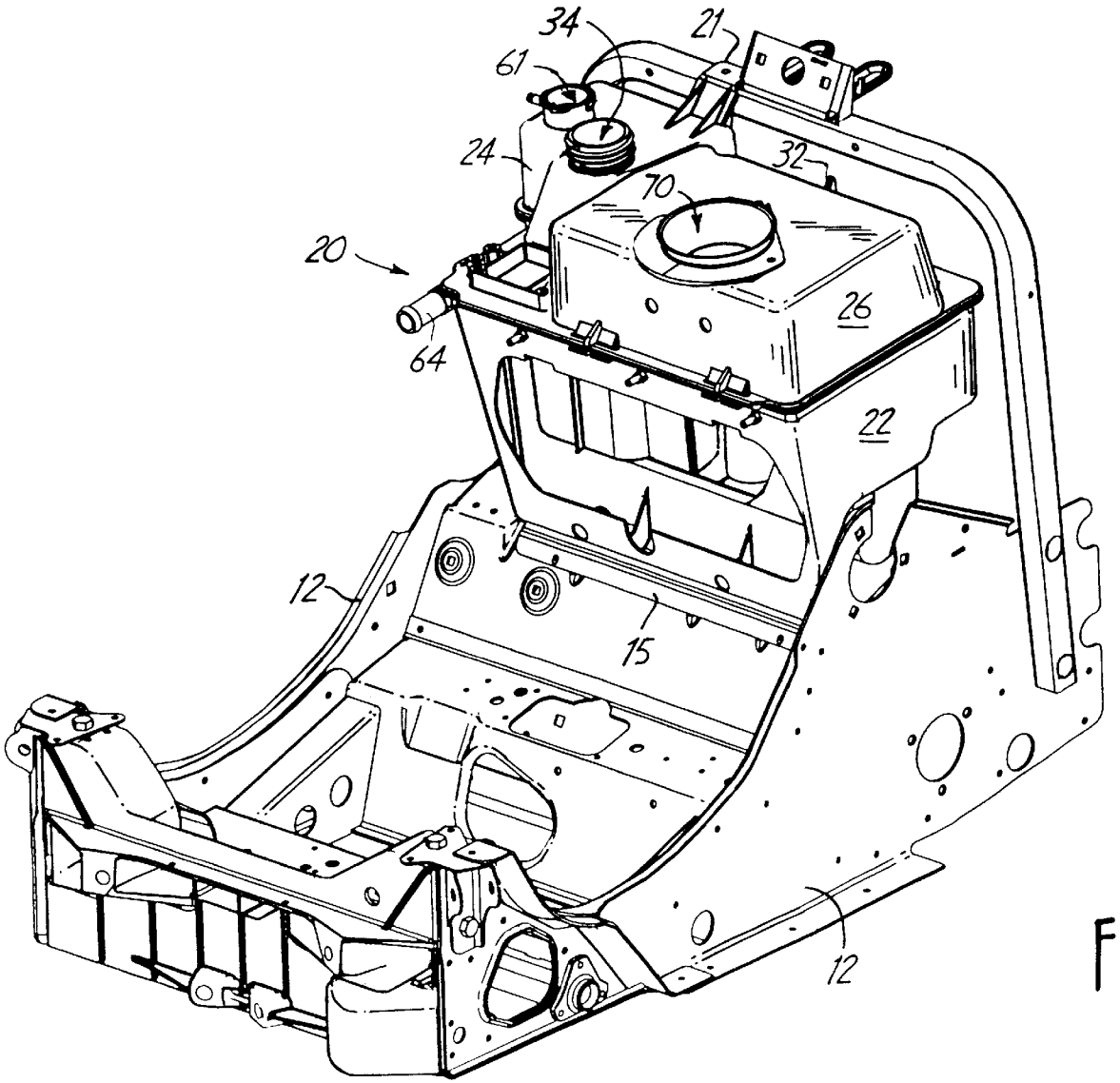
FIG. 2 is a perspective view of a portion of the chassis of a snowmobile in which the combined air box, coolant reservoir and oil tank of the invention is mounted.
Figure 3:
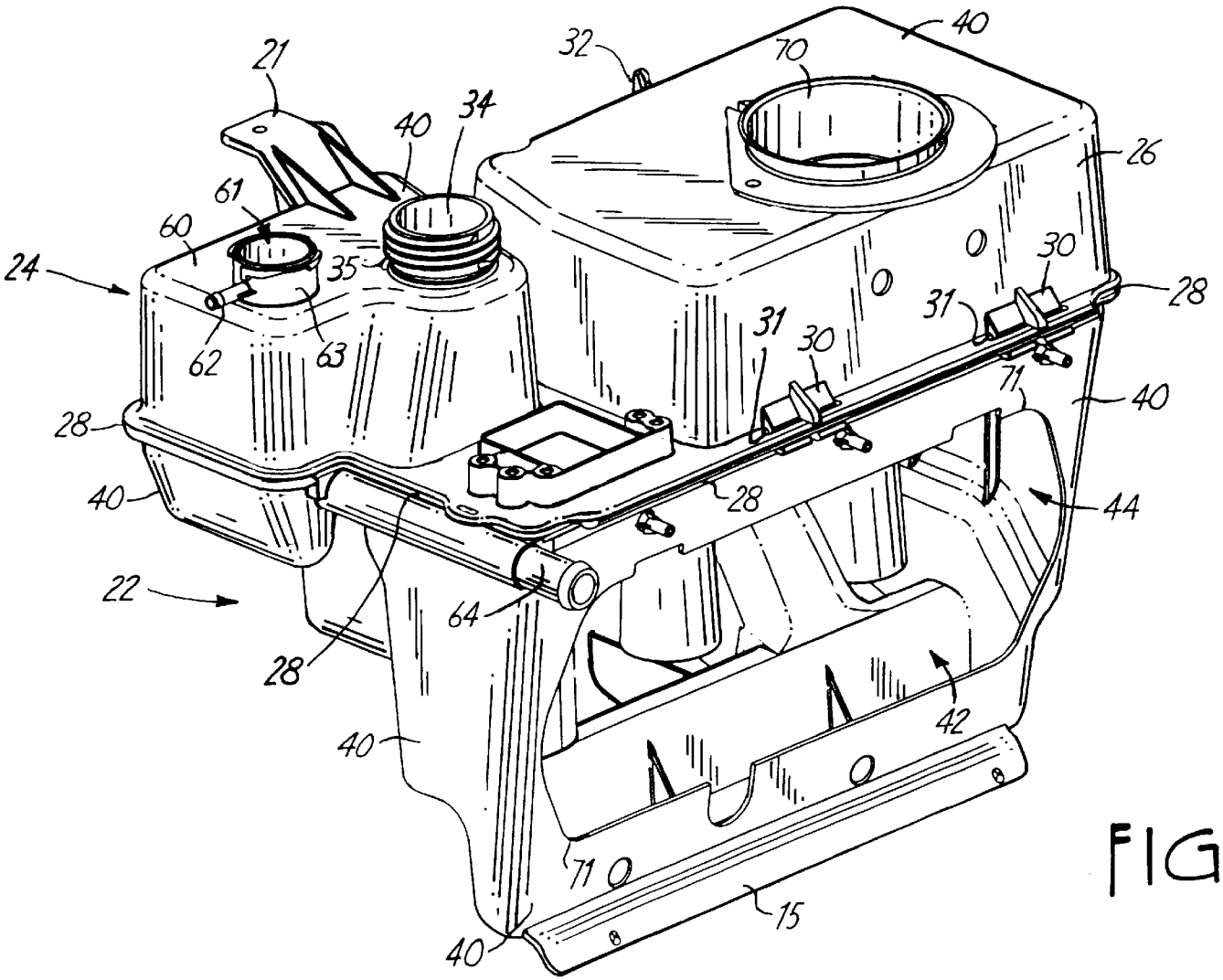
FIG. 3 is a perspective view of the combined air box, coolant reservoir and oil tank of the invention.
Figure 4:
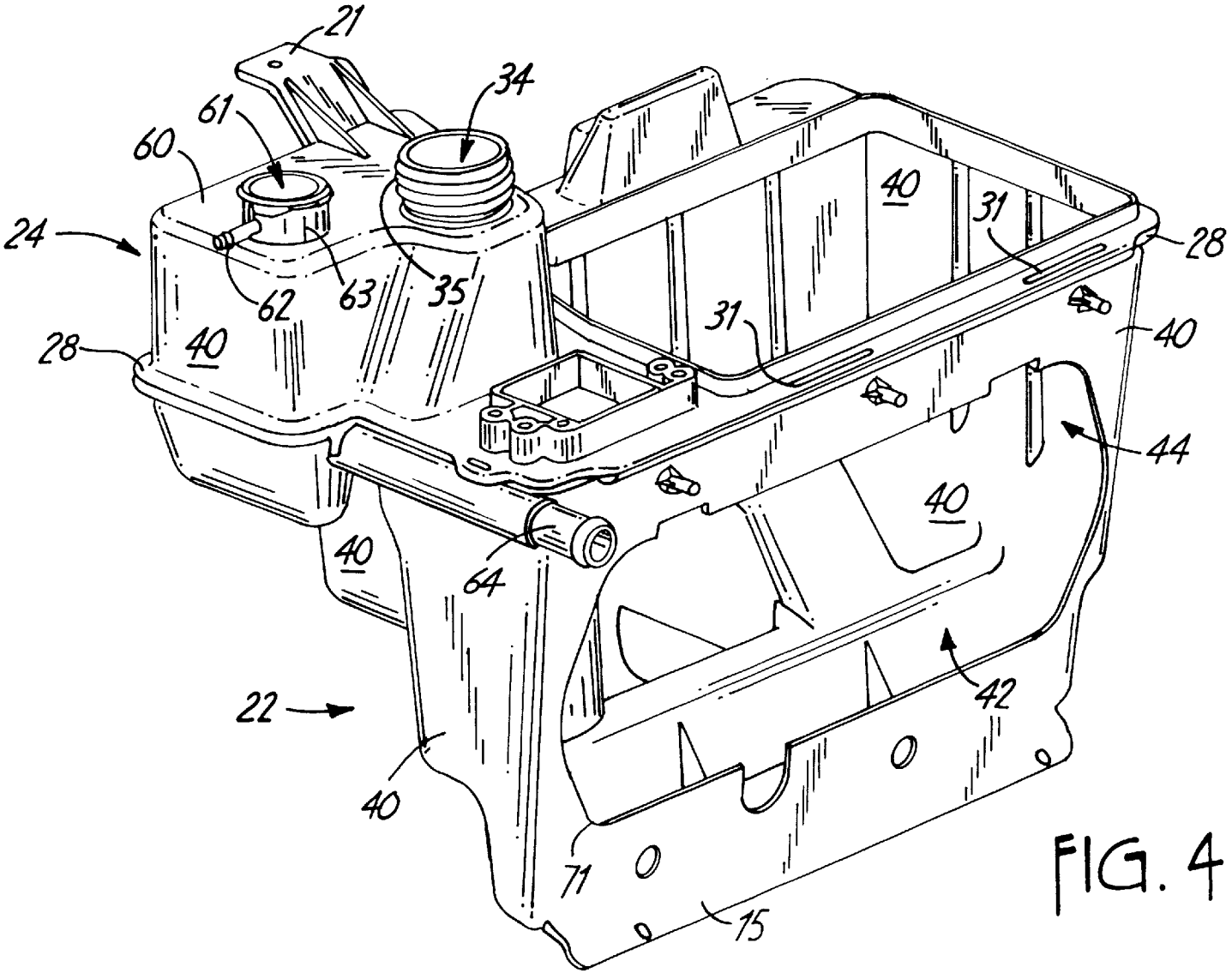
FIG. 4 is a perspective view of the combined air box, coolant reservoir and oil tank of the invention with a top portion of the air box removed.
Figure 5:
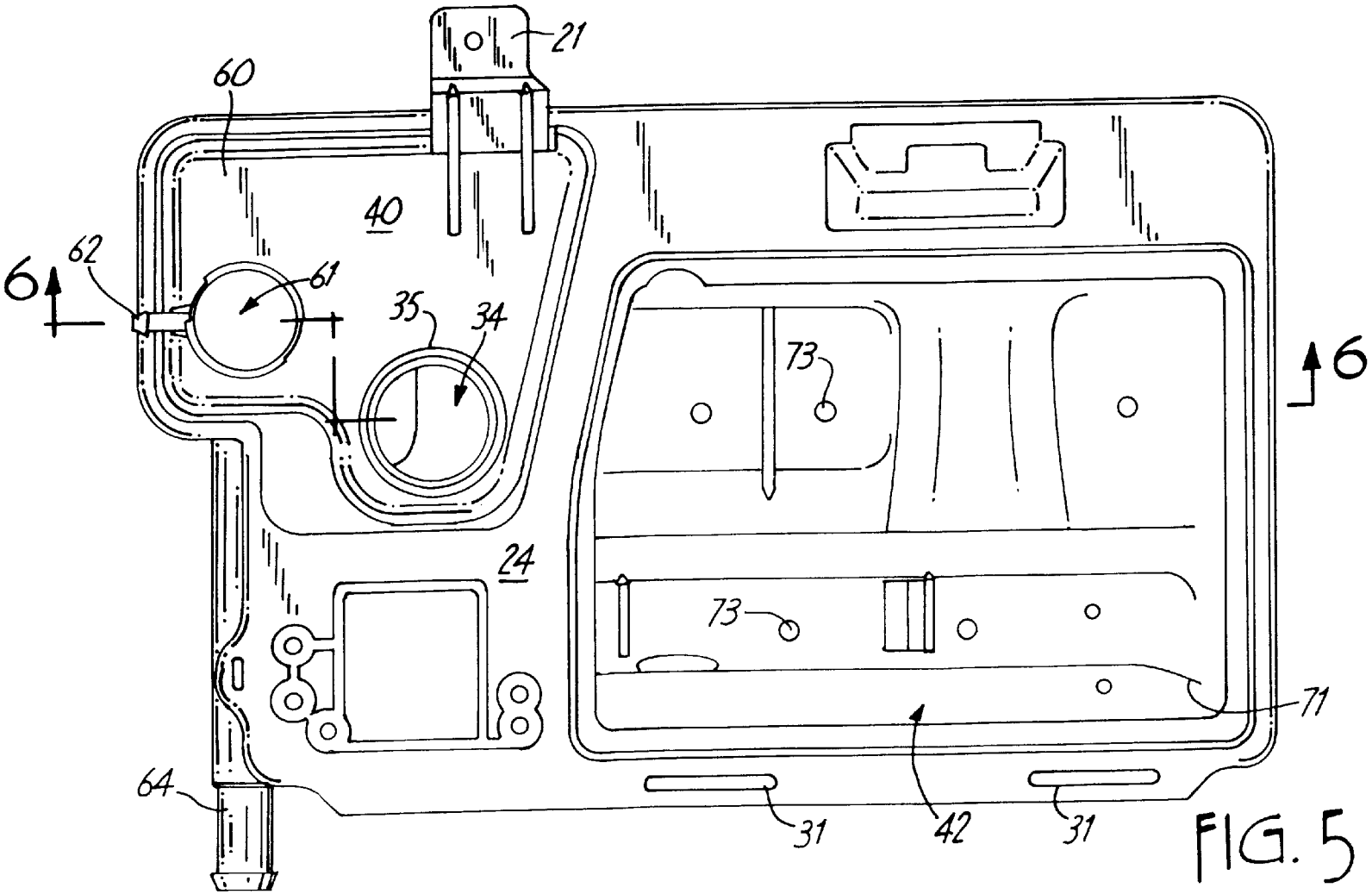
FIG. 5 is a top view of FIG. 4.
Figure 6:
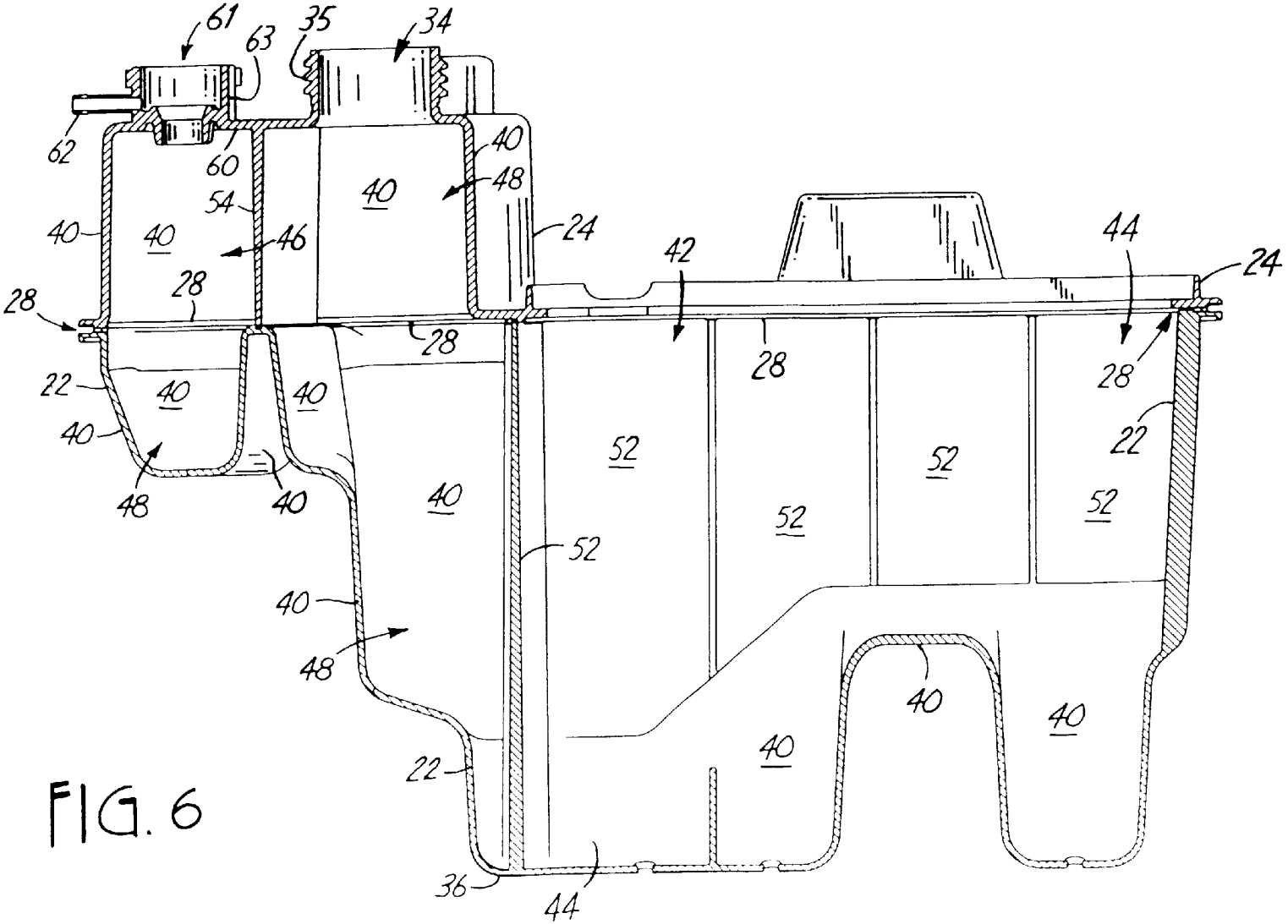
FIG. 6 is a cross-sectional view of FIG. 5, taken along lines 6—6 thereof.
Figure 7:
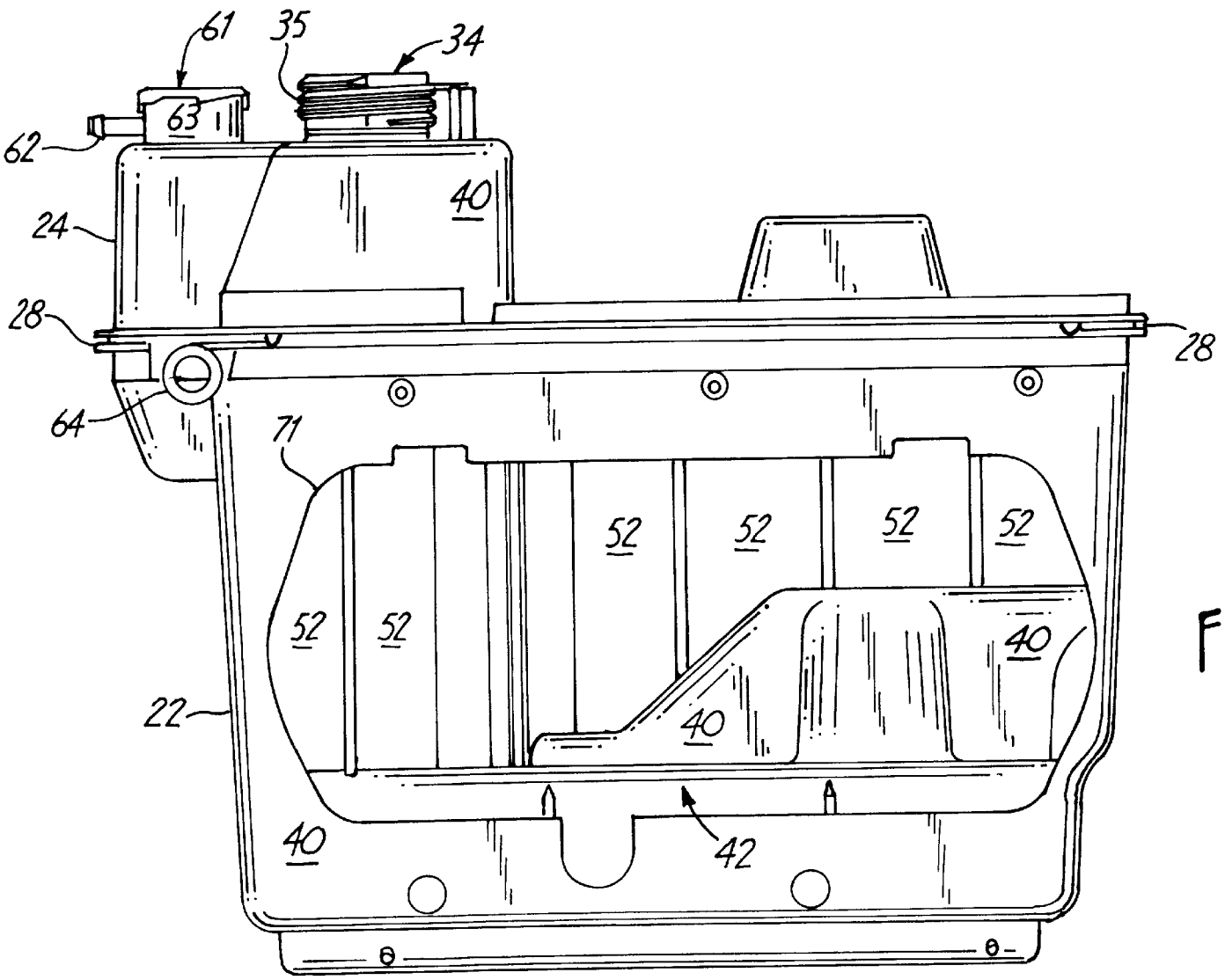
FIG. 7 is a front view of FIG. 6.
Figure 8:
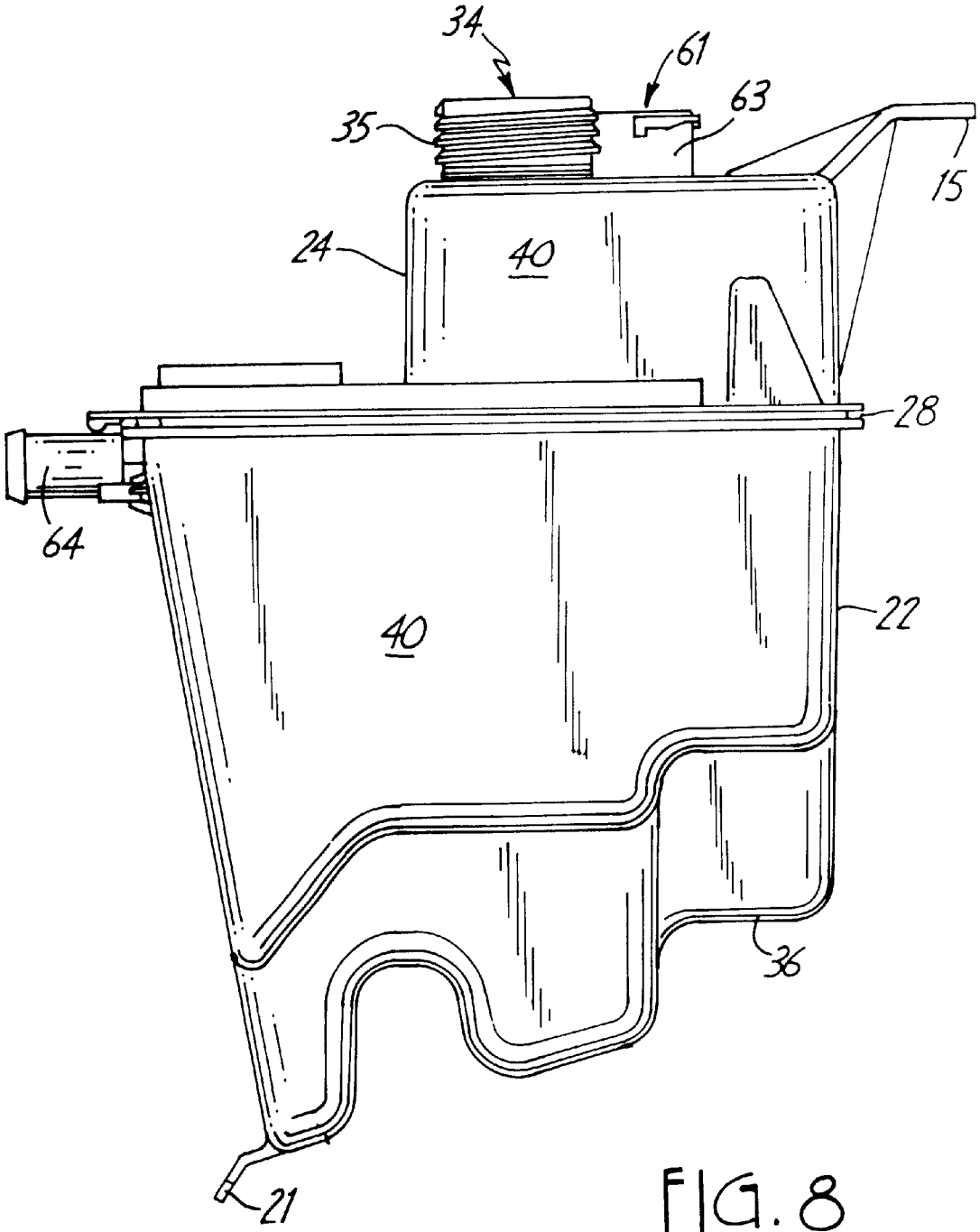
FIG. 8 is a left side view of FIG. 6.
Figure 9:
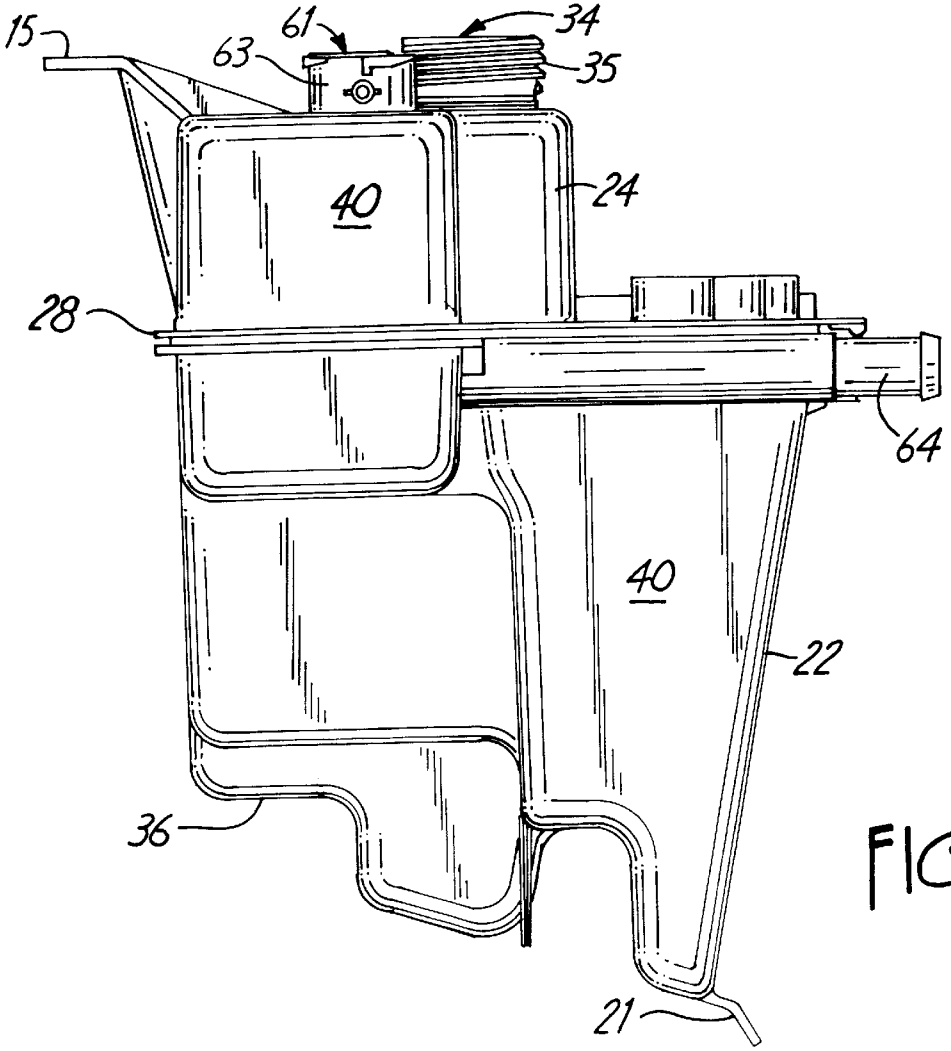
FIG. 9 is a right side view of FIG. 6.
Figure 10:
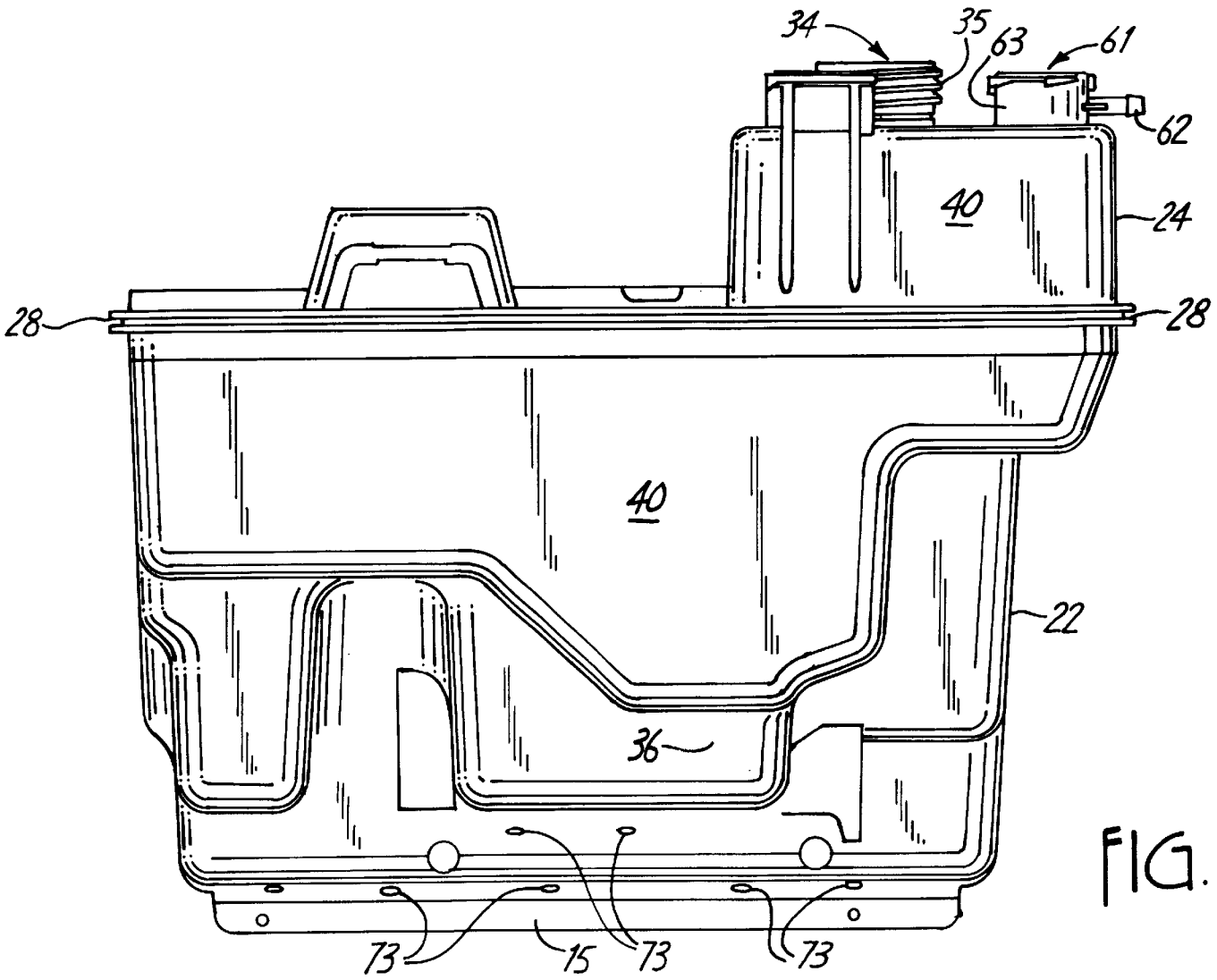
FIG. 10 is a rear view of FIG. 6.
Figure 11:
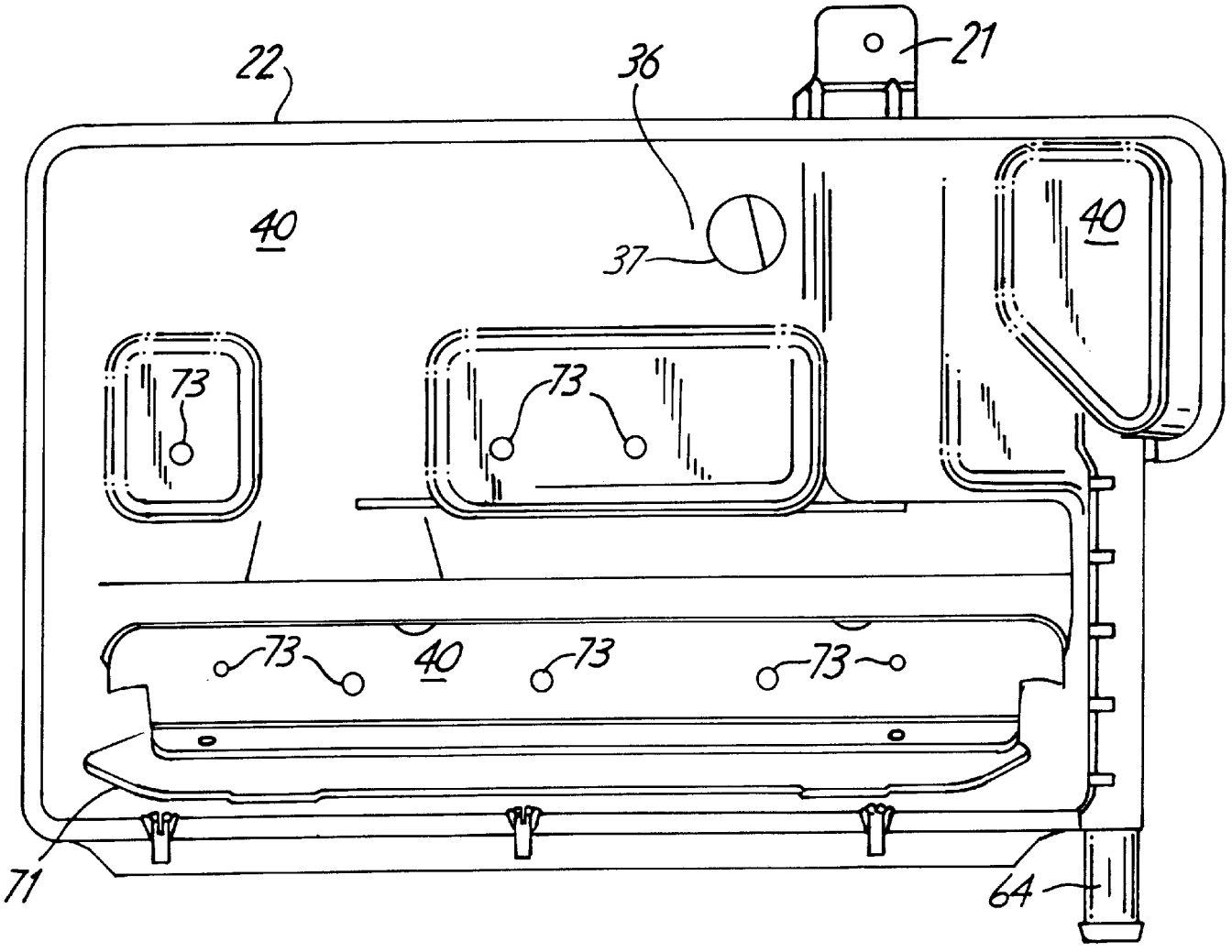
FIG. 11 is a bottom view of FIG. 6.
Figure 12:
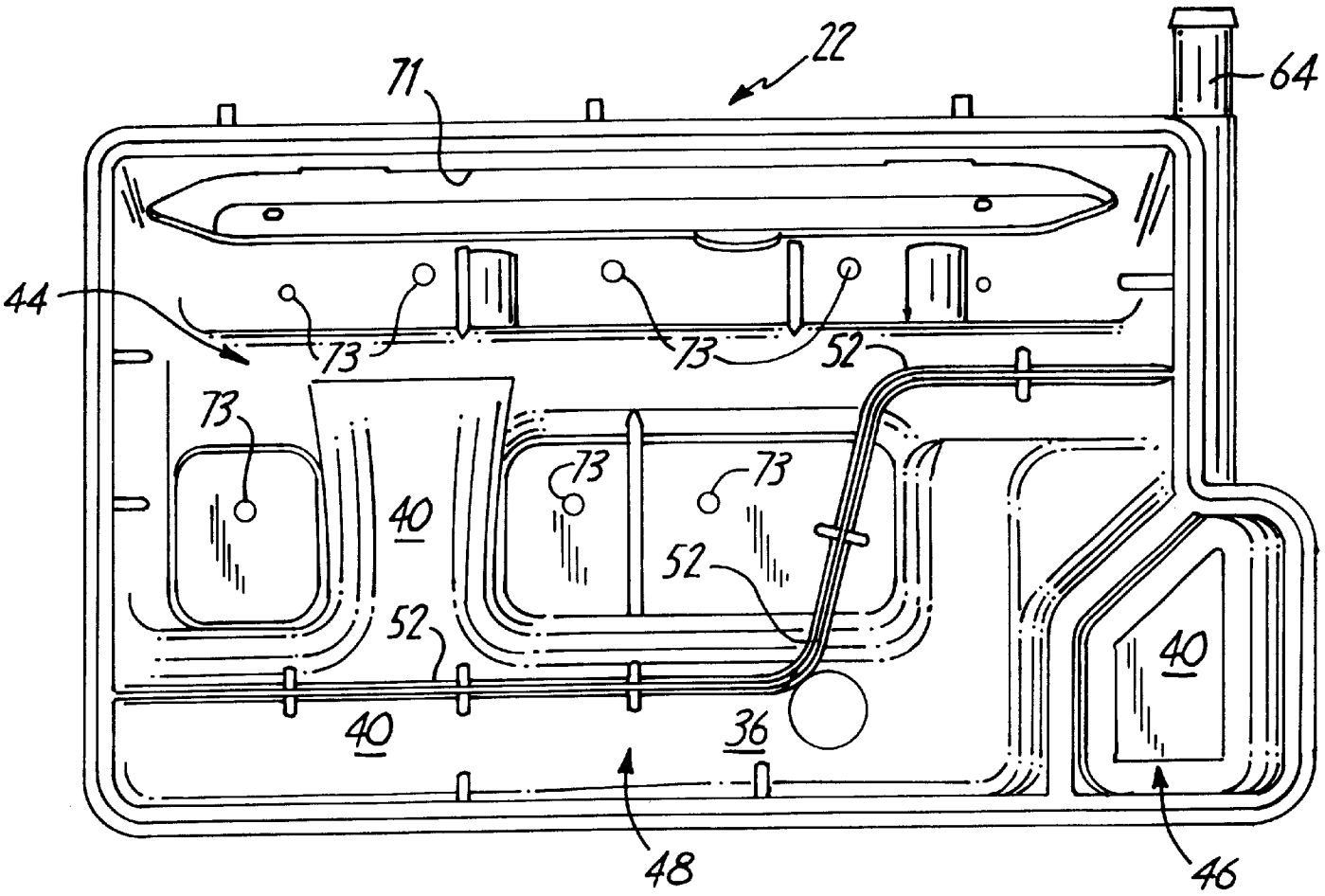
FIG. 12 is a top view of just the lower molding of the combined air box, coolant reservoir and oil tank of the invention.

FIG. 2 illustrates in greater detail a preferred mounting location on the chassis 12 of the snowmobile (only a portion of the chassis 12 being shown in FIG. 2, with the front of the snowmobile being oriented toward the left in this drawing). The snowmobile engine, not shown for the sake of clarity, is mounted to the chassis 12 just ahead of the combination unit 20, and the front end suspension components are mounted to the front portion of the part of the chassis shown in FIG. 2.

FIGS. 3–12 depict the details of the shape and configuration of a preferred combination unit 20, although it will be understood that a variety of shapes and configurations may be employed. The preferred combination unit 20 is constructed from three pieces, a lower molding 22, and upper molding 24, and an air box cap 26. The upper and lower moldings 22 and 24 preferably are sealed to each other by any suitable method, preferably by hot plate welding, thus creating a seam 28 at which these two parts are connected to each other. The air box cap 26 preferably is removable from the upper molding 24, thus giving the user access to the air box, e.g., to change or clean an air filter that may be carried within the air box chamber. Such removability may be provided in any suitable fashion; the preferred embodiment shown in the drawings utilizes a pair of tabs 30 received in complementary slots 31 in the upper molding 24 and a conventional latch 32 on the opposite side of the air box cap 26, the latch removably securing the air box cap 26 to the upper molding 24.

The lower molding 22, the upper molding 24 and the air box cap 26 together form a molded housing having a set of exterior walls 40 defining an interior cavity 42. The molded housing also includes at least two interior walls 52 and 54 that divide the interior cavity 42 into at least three chambers, namely an air box chamber 44, a coolant reservoir chamber 46, and an oil tank chamber 48. Each of these chambers is defined by at least a portion of the exterior walls 40 and at least a portion of at least one of the interior walls 52 and 54. Thus, each of the interior walls 52 and 54 simultaneously serves as a wall for two of the chambers, thereby saving space, weight and cost in the manufacture of the combination unit 20. In the preferred embodiment shown in the drawings, one of the interior walls 52 divides the air box chamber 44 from the coolant reservoir chamber 46, and the other interior wall 54 divides the coolant reservoir chamber 46 from the oil tank chamber 48. Other combinations and configurations may also be utilized, however.

The shape and configuration of the various chambers 44, 46, and 48 can be selected not only to provide the desired volume but also to fit into the space available, even though this makes the chamber somewhat irregularly shaped.

For example, in the preferred embodiment shown in the drawings the coolant reservoir chamber 46 is somewhat regularly shaped, but the oil tank chamber 48, being nestled between the coolant reservoir chamber 46 and the air box chamber 44, is quite irregularly shaped (not only being positioned between the other two chambers 44 and 46, but also extending along the back of the air box chamber 44, as can be most easily seen in FIGS. 4–6 and 12). Since oil is a liquid, however, the shape of the oil tank chamber 48 is of little consequence so long as it provides the required volume, has an opening 34 (desirably in an upper exterior wall portion) through which oil may be added to the chamber 48, and has a low point from which oil may be withdrawn. Preferably the opening 34 in the upper exterior wall portion is defined by an upwardly extending threaded throat 35 configured so that an oil tank cap (not shown) may be screwed on to seal this opening 34 during operation of the snowmobile. The low point of the oil tank chamber 48 is defined by a lower wall portion 36 (which is part of the exterior walls of the housing) that includes an orifice 37 through which oil may be withdrawn during use (most easily seen in, e.g., FIGS. 6, 8, and 10–11). In practice, a fitting is inserted into and sealed against this orifice 37, the fitting desirably including not only a tube through which the oil may be withdrawn but also, e.g., an oil level sensor and an oil filter.

The coolant reservoir chamber 46 in the preferred embodiment is somewhat smaller than the other chambers 44 and 48 (though the relative sizes of the chambers will vary from one snowmobile to another). The coolant reservoir chamber 46 includes an upper wall 60 (see FIG. 6) having an inlet 61 through which coolant may enter and exit the coolant reservoir chamber 46. Preferably the inlet 61 is defined by an upwardly extending throat 63 configured so that a coolant reservoir cap (not shown) may be secured to seal this opening during operation of the snowmobile. A small nipple 62 is also provided in the side of the throat 63 for connection to the cooling system, as well as a larger nipple 64 in the front side of the reservoir chamber 46.

The air box chamber 44 includes an air inlet 70 and an air outlet 71 formed in that portion of the exterior walls that defines the air box chamber 44. The inlet 70 and outlet 71 may be of any suitable size or configuration to provide the desired air flow characteristics required for the engine being utilized on the snowmobile. The outlet 71 in the preferred embodiment shown in the drawings is some what large and is shaped to mate with each of several adapter plates which are configured to connect the air box chamber 44 to any one of several different engines, each having a slightly different configuration. Drainage holes 73 desirably are provided in the lowest spots in the exterior walls of the air box chamber 44 to permit drainage of any moisture that might otherwise collect within this chamber 44. An air filter (not shown) may be disposed within the air box chamber 44 to prevent debris from entering the engine, and also to reduce engine noise by muffling somewhat the sounds generated by combustion in the engine cylinders.

FIG. 2 illustrates the mounting of the combined air box, coolant reservoir and oil tank of the invention 20 to the chassis 12 of a snowmobile. A mounting tab extends from the rear exterior walls 40 of the combination unit 20, and is connected by a bolt or other suitable connector to a frame portion 13 of the chassis 12. A longitudinal tab 15 is provided on the lower front edge for mounting to the adapter plate mentioned above. Obviously any other suitable mechanism may also be employed to appropriately mount the combination unit in a desired location on the snowmobile.

In use, the combination unit 20 is mounted to the chassis 12 in a convenient location, preferably under the hood 14, in the snowmobile. The oil tank chamber 48 is filled with oil, and the coolant reservoir chamber 46 is filled to the desired level with coolant. The unitary construction of the combination unit 20 saves both on weight and on the number of components to be manufacturer and to be mounted during assembly. Location of the oil tank cap, coolant reservoir cap and air box cap are convenient to the user during servicing, simply by raising the hood 14 of the snowmobile. Moreover, depending on the relative placement of the oil tank chamber 48 with respect to the coolant reservoir chamber 46, some warming of the oil by the coolant can be achieved through the common interior wall 54 shared by these two chambers, thereby causing the oil to flow better in cold weather conditions.

While a preferred embodiment of the present invention has been described, it should be understood that various changes, adaptations and modifications may be made therein without departing from the spirit of the invention and the scope of the appended claims.

What is claimed is:

1. A combined air box, coolant reservoir and oil tank for a snowmobile, comprising a molded housing having a set of exterior walls defining an interior cavity, and at least two interior walls dividing the interior cavity into at least three chambers, namely an air box chamber, a coolant reservoir chamber, and an oil tank chamber, each such chamber being defined by at least a portion of the exterior walls and at least a portion of at least one of the interior walls.

2. The combined air box, coolant reservoir and oil tank of claim 1 wherein one of the interior walls separates the air box chamber from the oil tank chamber, such interior wall thus simultaneously defining a portion of the air box chamber and a portion of the oil tank chamber.

3. The combined air box, coolant reservoir and oil tank of claim 1 wherein one of the interior walls separates the oil tank chamber from the coolant reservoir chamber, such interior wall thus simultaneously defining a portion of the oil tank chamber and a portion of the coolant reservoir.

4. The combined air box, coolant reservoir and oil tank of claim 1 wherein the coolant reservoir chamber includes an upper wall having an inlet through which coolant may enter and exit the coolant reservoir chamber.

5. The combined air box, coolant reservoir and oil tank of claim 1 wherein the oil tank chamber includes an upper wall having an opening through which oil may be added to the oil tank chamber, and a lower wall having an orifice through which oil may be withdrawn during use.

6. The combined air box, coolant reservoir and oil tank of claim 1 wherein the coolant reservoir chamber is at least partly filled with engine coolant, the oil tank chamber is at least partly filled with engine oil, and the air box chamber has an air inlet and an air outlet formed in that portion of the exterior walls that defines the air box chamber.

* * * * *